US007033459B2

(12) United States Patent
Rata et al.

(10) Patent No.: US 7,033,459 B2
(45) Date of Patent: Apr. 25, 2006

(54) ARRANGEMENT FOR DOCTORING A BELT OR A SOFT ROLL SURFACING IN A PAPER OR BOARD MACHINE

(75) Inventors: Ilkka Rata, Jyvsäkylä (FI); Juhani Vestola, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 446 days.

(21) Appl. No.: 10/171,193

(22) Filed: Jun. 12, 2002

(65) Prior Publication Data

US 2002/0189777 A1 Dec. 19, 2002

(30) Foreign Application Priority Data

Jun. 15, 2001 (FI) ..... 20010246 U

(51) Int. Cl.
*D21G 3/00* (2006.01)

(52) U.S. Cl. ..... 162/281; 162/272; 162/282; 118/413; 15/256.5; 15/256.51

(58) Field of Classification Search ..... 162/272, 162/274, 280, 281, 282; 15/256.5, 256.51; 118/261, 413; 399/273, 274; 101/169
See application file for complete search history.

(56) References Cited

U.S. PATENT DOCUMENTS 3,703,019 A * 11/1972 Bratt ..... 15/256.51
3,793,140 A * 2/1974 Corbellini ..... 162/352
4,895,071 A * 1/1990 Benton ..... 101/169
4,957,045 A * 9/1990 Messerschmitt ..... 101/123
4,978,999 A * 12/1990 Frankel et al. ..... 399/350
5,863,329 A * 1/1999 Yamanouchi ..... 118/100
6,312,520 B1 * 11/2001 Eriksson et al. ..... 118/106

FOREIGN PATENT DOCUMENTS

| | | | |
|---|---|---|---|
| JP | 11100790 | | 4/1999 |
| JP | 11-256493 | * | 9/1999 |
| JP | 11256493 | | 9/1999 |
| SU | 1745802 | * | 7/1992 |
| WO | 99/64674 | | 12/1999 |

* cited by examiner

*Primary Examiner*—Eric Hug
(74) *Attorney, Agent, or Firm*—Fildes & Outland, P.C.

(57) ABSTRACT

An arrangement for doctoring a belt or a soft roll surfacing in a paper or board machine includes a doctor set in connection with a surface with a doctor blade fitted in it for doctoring the surface. The doctor blade is at least partly of a material, the hardness of which is essentially equal to or less than the hardness of the material of the surface, in order to prevent the doctor blade from cutting into the surface. The material is arranged to form a layer extending over the entire width of the doctor blade, and the thickness of which throughout is at least half of the thickness of the doctor blade. A support construction is arranged in the doctor blade, which together with the layer is arranged to form the doctor blade.

4 Claims, 3 Drawing Sheets

ARRANGEMENT FOR DOCTORING A BELT OR A SOFT ROLL SURFACING IN A PAPER OR BOARD MACHINE

FIELD OF THE INVENTION

The present invention relates to an arrangement for doctoring a belt or a soft roll surfacing in a paper or board machine, which arrangement includes a doctor set in connection with a surface formed by a belt or a soft roll surfacing, with a doctor blade fitted in it for doctoring the surface using the doctor, and which doctor blade is at least partly of a material with a hardness that is essentially equal to or less than the hardness of the material of the surface, in order to prevent the doctor blade from cutting into the surface.

BACKGROUND OF THE INVENTION

The belts used particularly in wet pressing, drying, calendering, and coating in paper and board machines, especially transfer belts, must be doctored to keep their surfaces clean. The belts in question are, however, relatively soft, so that they are easily damaged, particularly when being doctored with a metal doctor blade. Various plastics are therefore usually used in place of metal in the manufacture of doctor blades. Certain plastics, however, particularly known fibre-reinforced plastics, are too hard for doctoring belts, so that to avoid damage and minimize wear, materials softer than known fibre-reinforced plastics must be used. For example, the edge of a doctor blade made from such a material will impact bluntly against a possible ridge or transverse groove in a belt and thus not damage the belt. The doctor blades generally used to doctor rolls are too hard, and thus are unsuitable for doctoring soft belts.

However, a doctor blade made from a soft material and particularly its edge will disadvantageously flex and creep due to the effect of the loading, temperature, and the duration of the loading. Thus, the doctoring result achieved with such a doctor is poor.

SUMMARY OF THE INVENTION

The present invention provides a new type of arrangement for doctoring a belt or a soft roll surfacing in a paper or board machine, the use of which arrangement will achieve a better doctoring result than previously while the doctor blade forming part of it can be manufactured and used more economically than previously.

More specifically, an arrangement for doctoring a belt or a soft roll surfacing in a paper or board machine includes a doctor set in connection with a surface formed by a belt or a soft roll surfacing. A doctor blade is fitted in it for doctoring the surface using the doctor, and the doctor blade is at least partly of a material, the hardness of which is essentially equal to or less than the hardness of the material of the surface, in order to prevent the doctor blade from cutting into the surface. The arrangement is characterized in that the said material is arranged to form a layer extending over the entire width of the doctor blade, and the thickness of which throughout is at least half of the thickness of the doctor blade and in which a support construction is arranged, which together with the layer is arranged to form the doctor blade, and, at least in an unused doctor blade, the support construction extends to a short distance from the point of contact of the doctor blade and the surface.

The arrangement can be further characterized in that the support construction is fitted inside the layer. The support construction can be fitted on at least one of the upper and lower surface of the layer.

The support construction, arranged to abut the wear margin of the doctor blade, is of a metal or a plastic composite material having a thickness of 5%–40%, preferably 15%–30% of the thickness of the doctor blade.

At the end of the support construction closest to the surface there is at least one of a rounded and shaped part, to prevent the support construction from cutting into the surface.

The support construction, arranged to extend to close to the point of contact of the doctor blade and the surface, is of a plastic material and its thickness is 20%–50%, preferably 30%–50% of the thickness of the doctor blade.

An additional layer, which is harder than the material and is arranged to extend to the point of contact of the doctor blade and the surface, can be arranged on the surface of the layer, in order to improve the doctoring result, which additional layer is a separate construction or a surfacing, and which is of a harder material than the layer.

The doctor blade used in the arrangement according to the invention can be manufactured in several different ways, in order to achieve the desired properties. In operation, the doctor blade does not bend deleteriously, permitting the use of a sufficient surface pressure. A good doctoring result is therefore achieved. In the doctor blade according to the invention, there are two operational components, which together form the doctor blade. This makes it possible to exploit the good properties of both components and to create a doctor blade that will not damage a soft belt or roll surfacing. The doctor blade is also economical to manufacture and can be installed in existing doctors.

These and other features and advantages of the invention will be more fully understood from the following detailed description of the invention taken together with the accompanying drawings.

DETAILED DESCRIPTION OF THE INVENTION

Figure 1A:
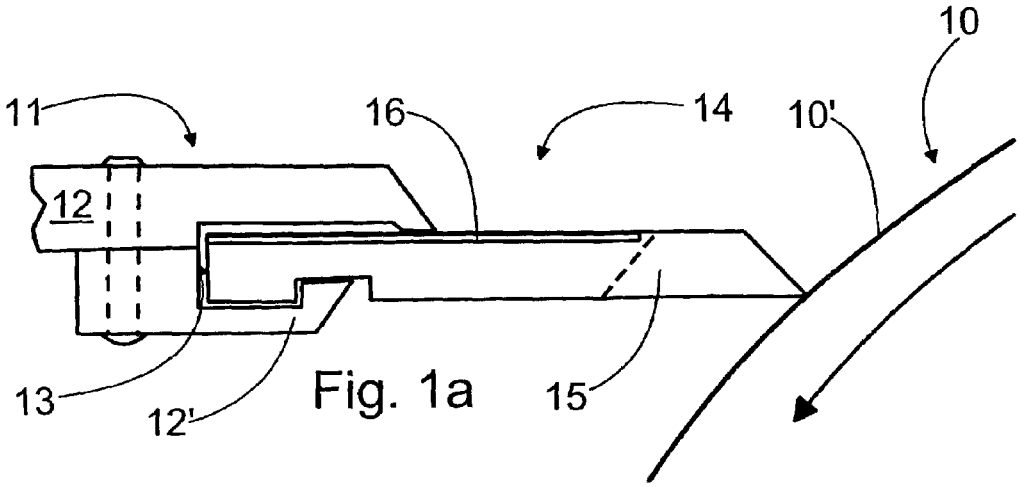
FIG. 1*a* shows a part side view of the arrangement according to the invention, arranged in connection with a belt.

FIG. 1*a* shows part of the arrangement according to the invention fitted in connection with a belt 10', which forms the surface 10 to be doctored. The direction of travel of the belt 10' is shown with an arrow. The arrangement includes a doctor, only part of the blade holder 11 of which is shown. In FIG. 1*a*, the doctor blade 14 is placed in a throat 13 formed by the jaws 12 and 12' of the blade holder 11, which, when doctoring a belt or soft roll surfacing, is at least partly made from a material with a hardness that is essentially equal to or less than the hardness of the material of the surface. This prevents the doctor blade from cutting into the surface. In practice, the material can be harder than the surface, provided it cannot cut into the surface. Suitable hardnesses are preferably determined separately for each pair of materials. In this case, the term cutting into refers, for example, to the doctor blade penetrating the surface, or other similar damage caused by the doctor blade. When using the doctor, the surface of the belt is doctored by the doctor blade. FIGS. 1*c*–2*c* show other embodiments of the invention, the same reference numbers being used for components with the same function.

According to the invention, the material described above, which does not damage the surface, is arranged to form a layer 15 extending over the entire width of the doctor blade. In addition, the thickness of the layer 15 throughout is at least half of the thickness of the doctor blade 14, thus achieving sufficient wear resistance. Further, a support construction 16 is arranged in the layer 15 and, together with the layer 15, is arranged to form the doctor blade 14. Thus, the doctor blade will not bend detrimentally. This also makes it possible to use the doctor with a greater surface pressure. It also permits doctor blades that are thinner than before. In practice, at least in an unused doctor blade the support construction 16 extends to a short distance from the contact point of the doctor blade 14 and the belt 10'. In other words, the support construction does not extend to the belt. A substantially harder material than the belt can therefore be used as the support construction, without any risk of damage. In FIGS. 1*a*–3*c*, the doctor blades 14 are unused and the wear margin of the doctor blade 14 is shown by broken lines. Even when doctoring with a worn doctor blade, the belt always meets the layer first, which impacts bluntly rather than cutting in. The doctor blades can also be attached to the blade holder in some other known manner than that shown, for example, in 1*a*.

The material described above that will not damage the surface is, for example, high density polyethylene (HDPE), polyurethane (PU), or polytetrafluoroethylene (PTFE), which are soft and have a low coefficient of friction. The softness of the said materials is such that they cannot penetrate conventional belt and surfacing materials by cutting into them. Other materials with corresponding properties can also be used to manufacture the doctor blade. The layer and the support construction are joined to each other using a suitable method, such as gluing, lamination, or setting the support construction in the desired place during the molding stage.

In FIG. 1*a*, the support construction 16 is arranged on the upper surface of the layer 15. The term upper surface refers to the surface of the doctor blade that comes first in the direction of travel of the belt. In this case, the upper surface is uppermost, but, depending on the position, it may also be the bottommost. According to FIG. 1*b*, the support construction 16 can also be separate, in which case the locking effect of its shape holds it in position in the holder on top of the layer 15. Thus, when the doctor blade is changed, the support construction can be easily detached and re-installed in the holder with a new doctor blade. Due to the thinness of the support construction, metal or a composite material is used in its manufacture, to achieve sufficient stiffness. On account of the hardness of these materials, the support construction is arranged to stop at the wear margin of the doctor blade. The wear margin is dimensioned in such a way that the unsupported layer is not allowed to bend detrimentally while the wear margin is enough up to the limit value of the blade angle, or is otherwise sufficient in practice. The blade angle changes as the doctor blade wears and the blade holder turns while specific limits, which depend on the position, are set for it. In FIGS. 1*a*–3*c*, the wear margin is shown by a broken line. It is also possible to adapt the doctor blade in such a way that the amount of fibre gradually increases, thus slowing the wear down after a specific angle.

Figure 1B:
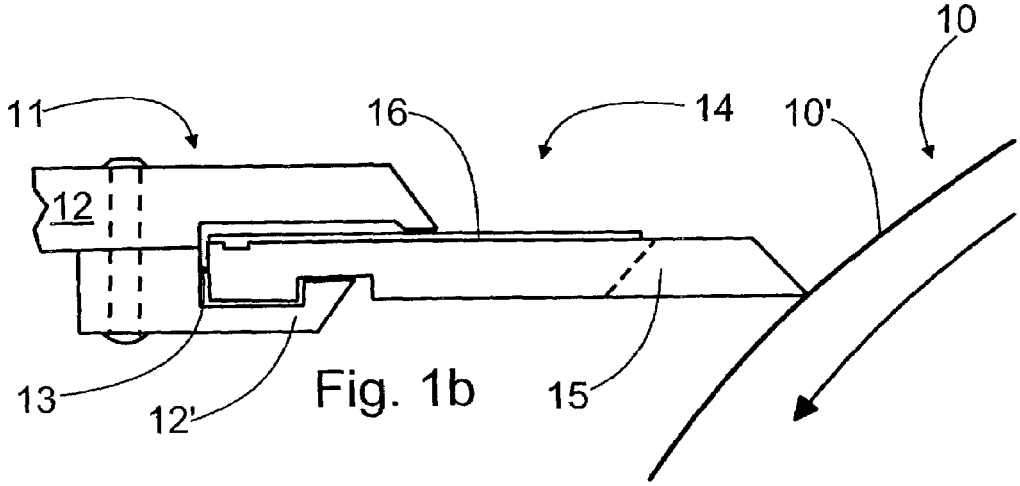
FIG. 1*b* shows a variation of the doctor blade of FIG. 1*a;*

The support construction is a permanent part of the doctor blade and it is joined to the layer during the manufacture of the doctor blade. In the embodiment of FIG. 1*b*, the support construction can, however, be suitably arranged to be separate, thus avoiding, for example, the stresses caused by thermal expansion in the layer and the support construction. The support construction 16 of FIGS. 1*a* and 1*b* is made from sheet metal or from fibre-reinforced plastic.

Figure 1C:
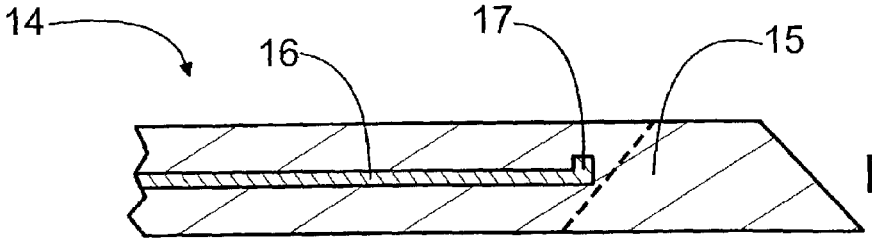
FIG. 1*c* shows a part cross-section of a second embodiment of the doctor blade used in the arrangement according to the invention.
Figure 3A:
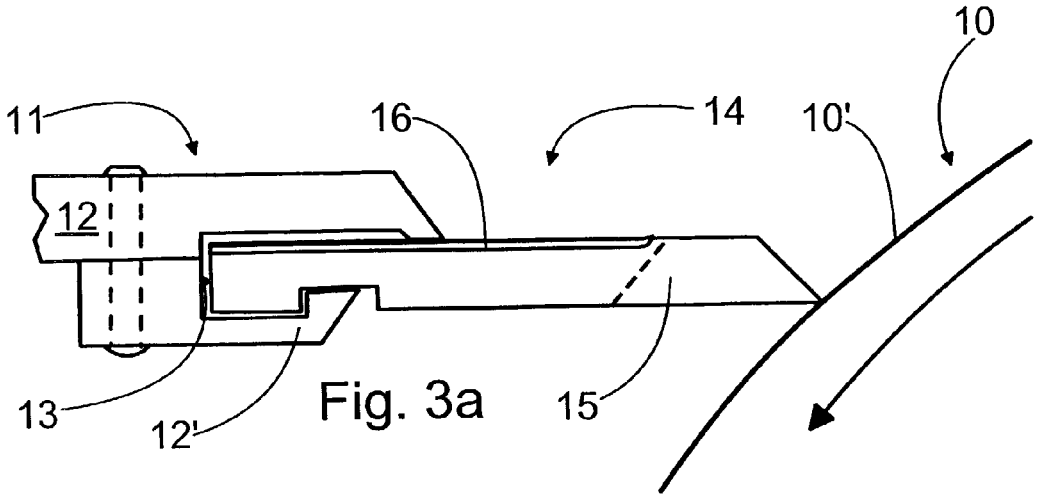
FIGS. 3*a*–3*c* show variations of the doctor blades of FIGS. 1*a*–1*c*.
Figure 3B:
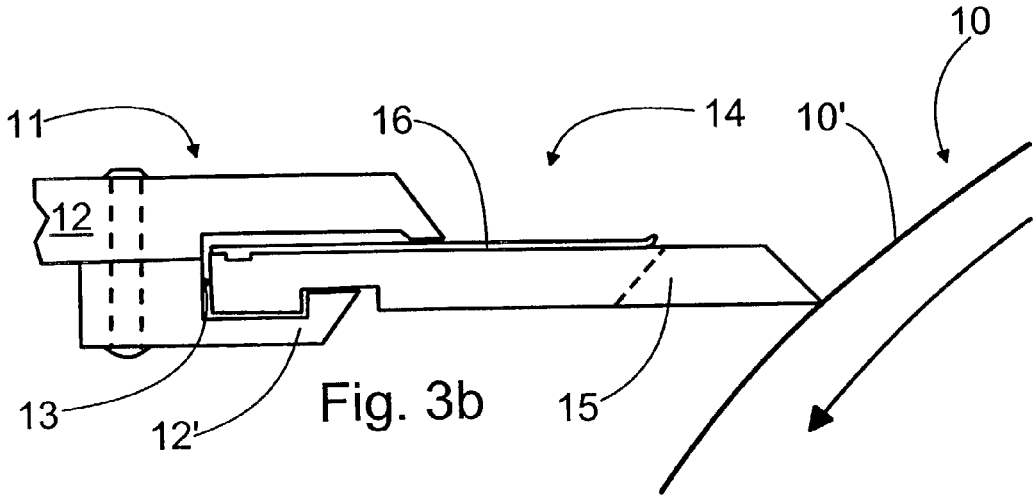
Figure 3C:
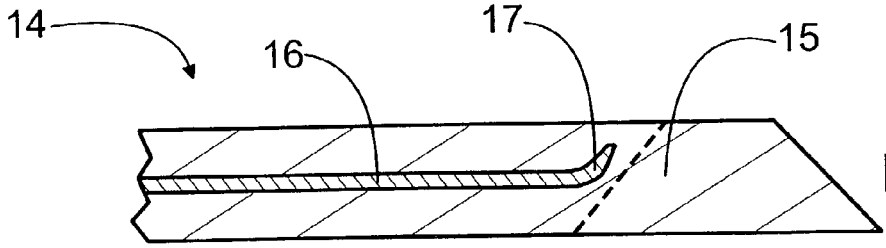

Generally, the thickness of the support construction arranged to be limited by the wear margin of the doctor blade is 5%–40%, preferably 15%–30% of the thickness of the doctor blade. This will then achieve a sufficient stiffness in the doctor blade. In FIG. 1*c*, the support construction 16 is fitted inside the layer 15 and is preferably a metal plate, which has the necessary various protrusions 17 for securing the layer 15 and the support construction 16 to each other. According to FIG. 2*a*, the support construction 16 can also comprise, for example, a fibre fabric or staple fibers, which create the desired stiffness in the doctor blade. The shape of the support construction can vary in different embodiments and can be formed from several separate components. FIGS. 3*a*–3*c* show additional embodiments of the support construction 16. Here, a protrusion 17 at the end of the support construction 16 nearest to the surface 10 is shaped to prevent the support construction 16 from cutting into the surface 10. In thick support constructions, a simple rounding may be sufficient. In FIGS. 3*a*–3*c*, the end of the shaped support construction forms a construction like the point of a ski, which, in a worn doctor blade, can lie against the surface, without, however, damaging it.

Figure 2A:
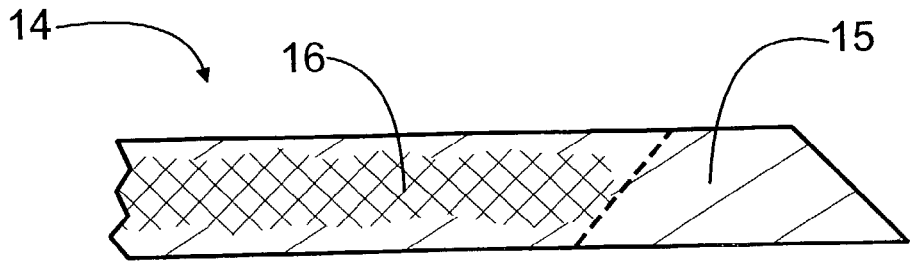
FIG. 2*a* shows similarly to FIG. 1*c* a third embodiment of the doctor blade used in the arrangement according to the invention.
Figure 2B:
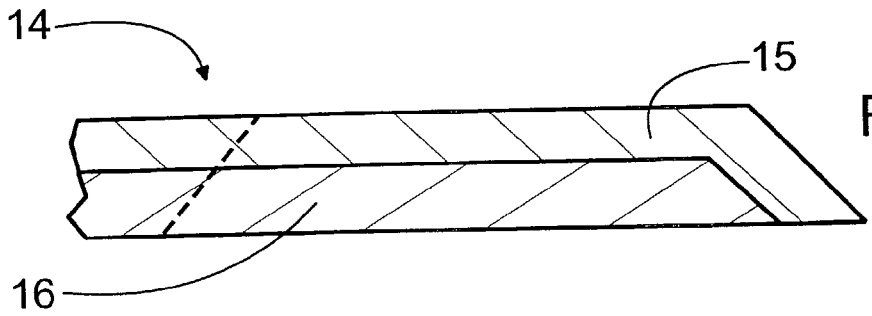
FIG. 2*b* shows similarly to FIG. 1*c* a fourth embodiment of the doctor blade used in the arrangement according to the invention.

In FIG. 2*b*, the support construction 16 is arranged on the undersurface of the layer 15. In addition, the support construction 16 extends to close to the point of contact between the doctor blade 14 and the belt 10'. Unlike in the previous embodiments, the support construction is of a plastic material and its thickness is 20%–50%, preferably 30%–40% of the thickness of the doctor blade. The support construction is harder than the layer, thus creating sufficient stiffness in the doctor blade. In this case, the preferred material for manufacturing the support construction is polyurethane (PU) or polypropylene (PP), the hardness of which can be easily selected to be suitable and which have good wear resistance. Due to the construction described, the layer always comes before the support construction in the direction of travel of the belt. Thus, when the doctor blade wears, and the support construction possibly strikes the belt, the belt will not be damaged as the layer impacts bluntly when it hits a protrusion.

Figure 2C:
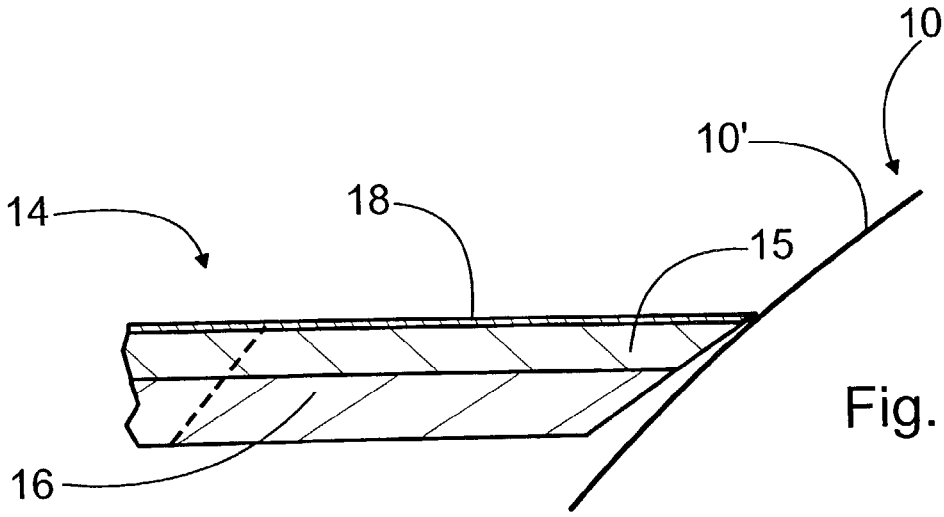
FIG. 2*c* shows similarly to FIG. 1*c* a fifth embodiment of the doctor blade used in the arrangement according to the invention.

FIG. 2*c* shows a doctor blade 14 developed from the previous embodiments. In this case, an additional layer 18 of harder material is arranged on the upper surface of the layer 15 and extends to the point of contact between the doctor blade 14 and the belt 10'. In addition, the boundary surface between the layer 15 and the support construction 16 is flat, facilitating the manufacture of the doctor blade. In the embodiment in question, an inverted front bevel is used, so that even in a new doctor blade 14, the layer 15 contacts the belt before the support construction 16. The thin additional layer remains sharp the whole time, thus improving the doctoring result. The use of the additional layer also increases the stiffness of the doctor blade. The hard, but thin additional layer impacts the belt bluntly like the soft layer, without damaging it. In practice, the additional layer is a separate construction, or even a surfacing. The additional layer can also be manufactured, for example, thermally using spraying, painting, or vaporization techniques. The additional layer can also be ceramic, such as glass or various oxides. Various metals and polymers are also possible. What is essential is that the additional layer is thin enough not to prevent the layer from impacting bluntly. By using various surfacings, the desired hardeners and stiffeners can also be created in the doctor blade. Though the additional layer is referred to in connection with the embodiment shown in FIG. 2*c*, it can also be used in the other embodiments described above.

The use of the arrangement according to the invention will achieve a good doctoring result. In addition, the doctor blade used in the arrangement has a simple construction and its use in doctoring belts and soft roll surfacings is safe. By means of various embodiments, a doctoring effect suitable for each position is achieved while the doctor blade can be attached in several different ways. What is essential, however, is a doctor blade that does not damage a belt or soft roll surfacing, in which a layer formed of a material that does not penetrate the surface and its related support construction act together. Such a doctor blade has a sufficient wear margin and it can be loaded sufficiently.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An arrangement for doctoring a belt or a soft roll surfacing in a paper or board machine, which arrangement includes a doctor set in connection with a surface formed by a belt or a soft roll surfacing, with a doctor blade fitted in it for doctoring the surface using the doctor, and which doctor blade is at least partly of a material, the hardness of which is essentially equal to or less than the hardness of the material of the surface, in order to prevent the doctor blade from cutting into the surface, characterized in that the said doctor blade material is arranged to form a layer extending over the entire width of the doctor blade, and the thickness of which throughout is at least half of the thickness of the doctor blade and in which a support construction is arranged for creating sufficient stiffness in the doctor blade, which support construction together with the layer is arranged to form the doctor blade, and, at least in an unused doctor blade, the support construction extends to a short distance from the point of contact of the doctor blade and the surface, the support construction being fitted inside the layer and the support construction is one of a metal and a plastic composite material.

2. An arrangement for doctoring a belt or a soft roll surfacing in a paper or board machine, which arrangement includes a doctor set in connection with a surface formed by a belt or a soft roll surfacing, with a doctor blade fitted in it for doctoring the surface using the doctor, and which doctor blade is at least partly of a material, the hardness of which is essentially equal to or less than the hardness of the material of the surface, in order to prevent the doctor blade from cutting into the surface, characterized in that the said doctor blade material is arranged to form a layer extending over the entire width of the doctor blade, and the thickness of which throughout is at least half of the thickness of the doctor blade and in which a support construction is arranged for creating sufficient stiffness in the doctor blade, which support construction together with the layer is arranged to form the doctor blade; and, at least in an unused doctor blade, the support construction extends to a short distance from the point of contact of the doctor blade and the surface, the support construction, arranged to abut the wear margin of the doctor blade, has a thickness of 5%–40% of the thickness of the doctor blade, at the end of the support construction closest to the surface there is at least one of a rounded and shaped part, to prevent the support construction from cutting into the surface and the support construction is one of a metal and a plastic composite material.

3. An arrangement for doctoring a belt or a soft roll surfacing in a paper or board machine, which arrangement includes a doctor set in connection with a surface formed by a belt or a soft roll surfacing, with a doctor blade fitted in it for doctoring the surface using the doctor, and which doctor blade is at least partly of a material, the hardness of which is essentially equal to or less than the hardness of the material of the surface, in order to prevent the doctor blade from cutting into the surface, characterized in that the said doctor blade material is arranged to form a layer extending over the entire width of the doctor blade, and the thickness of which throughout is at least half of the thickness of the doctor blade and in which a support construction is arranged for creating sufficient stiffness in the doctor blade, which support construction together with the layer is arranged to form the doctor blade, and, at least in an unused doctor blade, the support construction extends to a short distance from the point of contact of the doctor blade and the surface, the support construction, arranged to extend to close to the point of contact of the doctor blade and the surface, is of a thickness 20%–50%, of the thickness of the doctor blade, and the support construction is one of a metal and a plastic composite material.

4. An arrangement for doctoring a belt or a soft roll surfacing in a paper or board machine, which arrangement includes a doctor set in connection with a surface formed by a belt or a soft roll surfacing, with a doctor blade fitted in it for doctoring the surface using the doctor, and which doctor blade is at least partly of a material, the hardness of which is essentially equal to or less than the hardness of the material of the surface, in order to prevent the doctor blade from cutting into the surface, characterized in that the said doctor blade material is arranged to form a layer extending over the entire width of the doctor blade, and the thickness of which throughout is at least half of the thickness of the doctor blade and in which a support construction is arranged for creating sufficient stiffness in the doctor blade, which support construction together with the layer is arranged to form the doctor blade, and, at least in an unused doctor blade, the support construction extends to a short distance from the point of contact of the doctor blade and the surface, the support construction is one of a metal and a plastic composite material, and an additional layer is disposed on the doctor blade surface and extends from the point of contact of the doctor blade, in order to improve the doctoring result, which additional layer is a separate construction or a surfacing, and which is of a harder material than the layer.

* * * * *